US005635688A

United States Patent [19]

Kantesaria et al.

[11] Patent Number: 5,635,688

[45] Date of Patent: Jun. 3, 1997

[54] START JERK REDUCTION FOR AN ELEVATOR

[75] Inventors: Raj Kantesaria, Bloomfield; Mark E. Shepard; Donald F. Cominelli, both of Bristol, all of Conn.

[73] Assignee: Otis Elevator Company, Farmington, Conn.

[21] Appl. No.: 332,193

[22] Filed: Oct. 31, 1994

[51] Int. Cl.[6] ..... B66B 1/34

[52] U.S. Cl. ..... 187/292

[58] Field of Search ..... 187/393, 394, 187/292, 293, 291

[56] References Cited

U.S. PATENT DOCUMENTS 5,076,399 12/1991 Horbruegger et al. ..... 187/116
5,424,498 6/1995 Spielbauer et al. ..... 187/292

FOREIGN PATENT DOCUMENTS 1-271382 10/1989 Japan ..... 187/292
3-243575 10/1991 Japan ..... 187/292

OTHER PUBLICATIONS

U.S. Ser. No: 8/268,208, (OT-1718A) entitled "Elevator Start Jerk Removal", by H. Spielbauer et al.

*Primary Examiner*—Robert Nappi

[57] ABSTRACT

At the beginning of a run of an elevator 4, from an elevator control 14 a stiction removing velocity signal 20 is provided to a drive control 24 for commanding the elevator until stiction is broken; then as soon as the elevator 4 moves a normal dictated velocity signal 21 controls the elevator 4 throughout the remainder of the run. In further accordance with the present invention, the stiction removing velocity signal 20 is provided prior to the dictated velocity signal 21 only when the elevator 4 is operating in a regenerative mode, as determined by the elevator 4 moving in the up direction while lightly loaded or moving in the down direction while heavily loaded.

20 Claims, 3 Drawing Sheets

START JERK REDUCTION FOR AN ELEVATOR

TECHNICAL FIELD

The present invention is related to geared elevators, and particularly to minimization of start jerk at the beginning of an elevator run.

BACKGROUND OF THE INVENTION

Many elevators include an elevator rope slung over a sheave with one end of the rope supporting an elevator and the other end supporting a counterweight. The elevator moves when the sheave is turned by a motor.

Elevator systems follow a dictated velocity profile. At a floor, an elevator is held in place by a brake. After a demand has been made for elevator service (for example, by a passenger pressing a hall button) the brake lifts, a velocity profile is dictated to a motor drive and the elevator is commanded to move in the direction and at the velocity dictated. On geared systems, however, static friction, or "stiction," in the gear box holds the elevator in place even as it is being commanded to follow an accelerating velocity profile and motor torque is increasing. Eventually, enough torque builds up to break the force of stiction and the elevator jerks free suddenly. This jerk, as the elevator begins to move, is called start jerk. It can be felt by passengers within the elevator and usually causes discomfort. It is also generally greater in geared than gearless systems.

A better elevator would be created if one could be made with minimal start jerk.

DISCLOSURE OF THE INVENTION

Objects of the present invention include reduction of start jerk in a geared elevator when the elevator drive is regenerating or motoring.

According to the present invention, at the beginning of a run of an elevator, from an elevator control a stiction removing velocity signal is provided to an elevator drive for commanding the elevator until stiction is broken; then, when stiction is broken a normal dictated velocity signal controls the elevator throughout the remainder of the run. In further accordance with the present invention, the stiction removing velocity signal is provided only when the elevator is operating in a regenerative mode, as determined by the elevator moving in the up direction while lightly loaded or moving in the down direction while heavily loaded.

These and other objects features and advantages will become more apparent in light of the drawings and the following text.

BEST MODE FOR CARRYING OUT THE INVENTION

Figure 1:
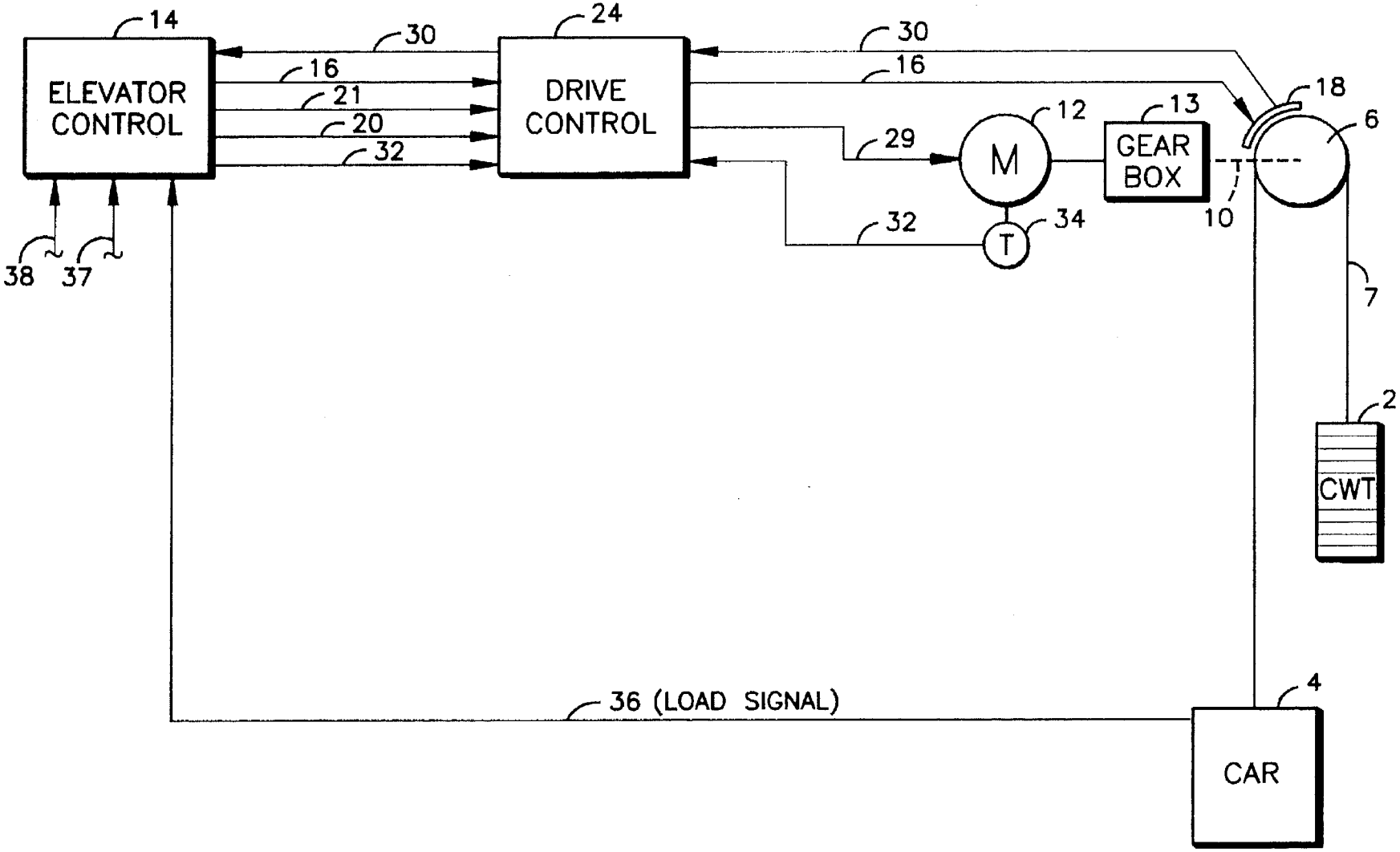
FIG. 1 is a block diagram of an elevator system according to the present invention.

In FIG. 1, a counterweight 2 and elevator 4 are connected to a sheave 6 by means of a rope 7. Rotation of sheave 6 occurs in response to rotation of a motor shaft 10 of a motor 12 through a gear box 13.

In FIG. 1, an elevator control 14 provides brake drop and lift commands 16 to an elevator brake 18. The elevator control 14 provides a stiction removing velocity signal 20 and a dictated velocity signal 21 to a drive control 24. The drive control 24, in response to either the stiction removing velocity signal 20 or dictated velocity 21, provides a torque signal 29 to the motor 12, causing the motor shaft 10 to turn and the elevator 4 to move. The motor drive 24 may be any one of numerous types of SCR, thyristor, IGBT or other electronic or non-electronic elevator drives. The elevator may be a geared elevator, hydraulic elevator or any other type of elevator system, lift or dumbwaiter.

Besides movement of the elevator 4 being conditioned on the stiction removing velocity signal 20 or dictated velocity signal 21, movement is conditioned upon whether the brake 18 is dropped to hold the elevator 4 still, or lifted to allow the elevator 4 to move. Brake lift and brake drop commands 16 are provided by the elevator control 14. The status of the elevator brake 18 as lifted or dropped is provided to the elevator control 14 on line 30 through the drive control 24. Motion of the elevator 4 is indicated by a motion signal on line 32 provided by a position transducer T 34 mounted a rotating shaft of the motor 12.

At the start of an elevator run, the elevator control 14 provides stiction removing velocity signal 20 to the drive control 14. When the motion signal 32 indicates motion of the elevator 4 and/or after a stiction time has expired, the stiction removing velocity signal 20 is zeroed in favor of the dictated velocity signal 21. The elevator control 14 is responsive to a load signal 36, indicative of the weight in the elevator 4, and also a gear ratio signal 38, for varying the value of the stiction removing velocity signal in response to one of a load signal, gear ratio signal 36, 38 or duty load signal derived from the load signal 32. From the load signal 36 a duty load signal (not shown in FIG. 1, but shown in FIG. 5) can further be formed by dividing a load signal (from load cells, not shown, which weigh the elevator load) by the rated load for the elevator 4. This division can occur external or internal to the elevator control 14.

Figure 2:
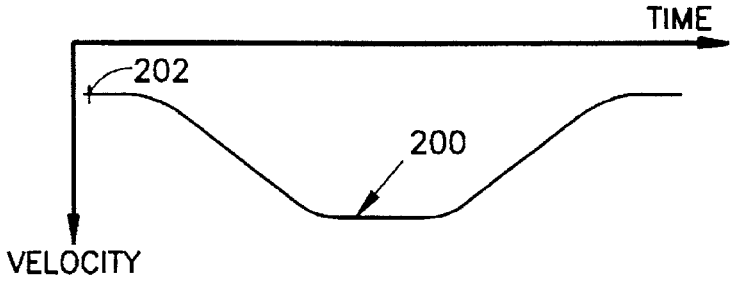
FIG. 2 is a graph of a dictated velocity profile.

FIG. 2 is a graph of dictated velocity vs. time from the beginning to end of an elevator run, shown as waveform 200. From standstill 202 at the beginning of the elevator run there is a gradual increase in dictated velocity. The waveform 200 is shown as a trough to represent an elevator moving in the down direction. The maximum value of the waveform 200 is the same for the up or down directions.

Figure 3:
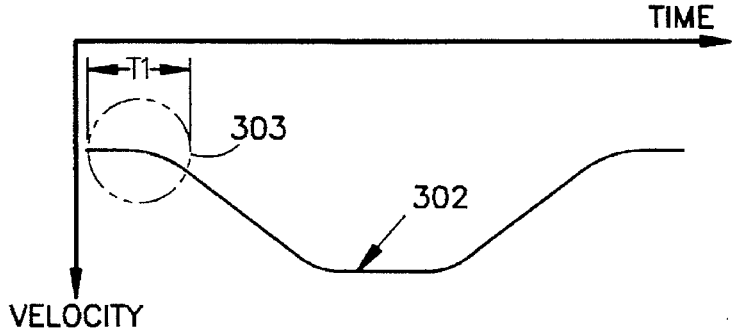
FIG. 3 is a graph of a dictated velocity profile including a stiction removing signal according to the present invention.

FIG. 3 is graph of dictated velocity vs. time according to the present invention, shown as waveform 302. Area 303 marks the stiction removing velocity as distinguished from the dictated velocity in the remaining part of waveform 302. For a brief period T1 at the beginning 304 of the elevator run, a stiction removing velocity signal is dictated for the purpose of overcoming stiction in a manner that will prevent start jerk from being felt by elevator passengers. After T1 has ended, when stiction is removed, the dictated velocity rather than the stiction removing velocity is dictated.

Figure 4:
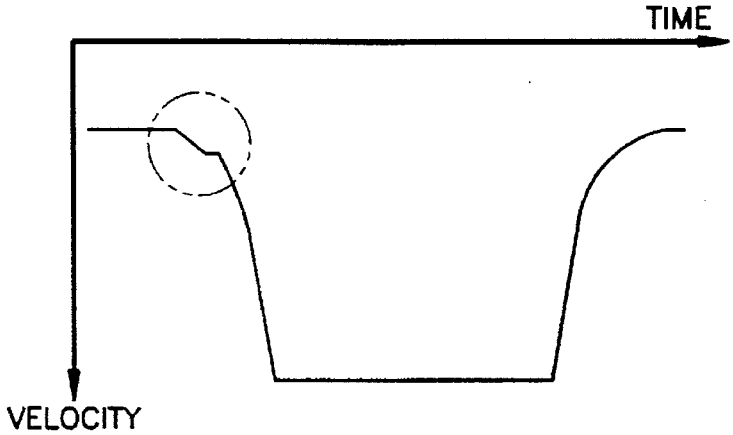
FIG. 4 is a magnified version of FIG. 3.

FIG. 4 is a graph of FIG. 3 magnified 8 times to show the stiction removing velocity signal in area 400.

Figure 5:
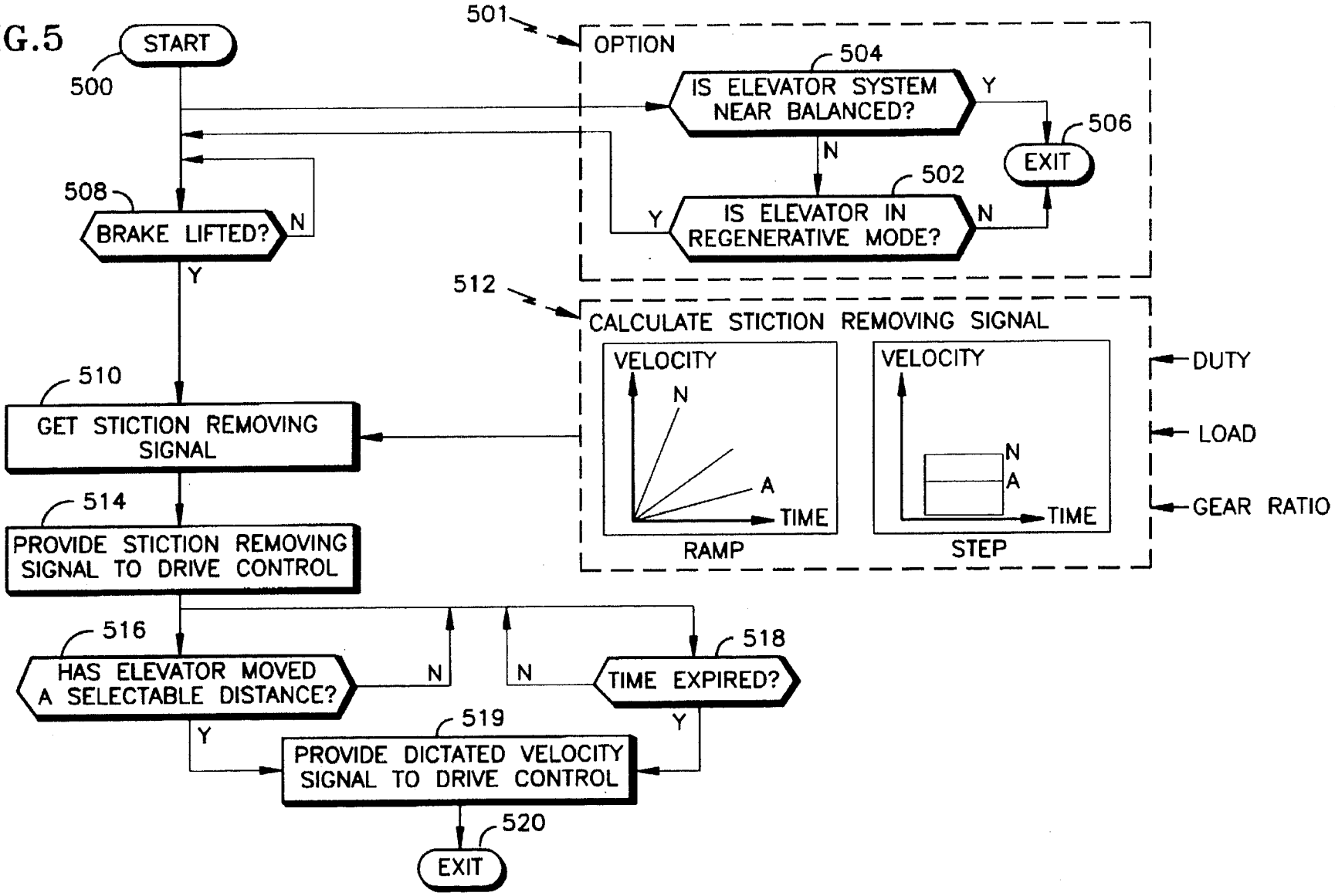
FIG. 5 is a flow chart incorporating the method of the present invention which is implemented by the hardware of FIG. 1.

FIG. 5 is a flowchart for executing the method of the present invention, for example in the elevator control 14.

After start, step 500, two steps may be taken at the option 501 of the elevator owner. It may be his choice that if the elevator 4 is not in the regenerative mode (traveling with a light load up or a heavy load down), step 502, or the elevator 4 approximately balances the counterweight 2, step 504, then the routine of FIG. 5 is exited, step 506.

Regardless whether the option 501 is taken, several initialization steps must be executed. The brake 18 must be lifted, step 508, and the stiction removing signal 20 must be obtained, step 510, from a subroutine 512 for calculating the stiction removing signal 20. The stiction removing signal 20 can be either a ramp or step function, and calculated in response to the load, duty load and/or gear ratio, step 512. The stiction in a geared elevator system is a function of duty load as well as gear ratio. Duty load is the maximum rated load for the elevator. An elevator with a 2000 kg duty load will have a higher stiction than an elevator with a 1000 kg duty load. Similarly, an elevator with a high gear ratio has greater stiction than an elevator with a low gear ratio. In response to the duty load, load signal or gear ratio, one of the functions A through N for the stiction removing signal 20 is provided as either a ramp or step function from look-up tables represented by the velocity v. time graphs in block 512. The choice of whether to use a ramp or a step (or other signal) is up to the designer or building owner and within the scope of the invention.

When the brake 18 is lifted, the stiction removing velocity signal 20 is provided to the drive control 24, step 514. The stiction removing velocity signal 20 is continually provided until either one of two events happens. Complete execution of the routine of FIG. 5 may be conditioned on either of these events; the choice is left to the designer of the elevator system and the exercise of that choice is within the scope of the invention. If the elevator 4 moves a selectable distance, step 516, or a time expires, step 518, the elevator control 14 provides the dictated velocity 21 to the drive control 24, step 519, and the routine is exited, step 520.

We claim:

1. A method of reducing start jerk in an elevator, comprising the steps of:

detecting the lifting of an elevator brake at the beginning of an elevator run;

providing a variable removing velocity signal to a drive control after the lifting of said brake;

providing a dictated velocity signal to said drive control in response to an event and for the duration of said elevator run.

2. The method of claim 1, wherein said event is the expiration of a time for the duration of said variable removing signal.

3. The method of claim 1, wherein said event is motion of said elevator.

4. The method of claim 1, wherein said method is executed only when said elevator is not in a regenerative mode.

5. The method of claim 1, wherein said method is not executed if said elevator, including an elevator load, approximately balances a counterweight to said elevator.

6. The method of claim 1, wherein said variable removing velocity signal is a step function, the magnitude of which is a function of a duty load for said elevator.

7. The method of claim 1, wherein said variable removing velocity signal is a ramp function, the slope of which is dependent upon a duty load for said elevator.

8. The method of claim 1, wherein said elevator is a geared elevator and wherein said variable removing velocity signal is a step function, the magnitude of which is a function of a gear ratio associated with said geared elevator.

9. The method of claim 1, wherein said elevator is a geared elevator and wherein said variable removing velocity signal is a ramp function, the slope of which is a function of a gear ratio associated with said geared elevator.

10. The method of claim 1, wherein said variable stiction removing velocity signal is dependent on elevator load.

11. An elevator system, comprising:

an elevator controller, responsive to a lift signal from an elevator brake for providing a variable stiction removing velocity signal to a drive control until an event and for providing a dictated velocity signal after said variable event;

an elevator drive, responsive to said stiction removing velocity signal and dictated velocity signal for providing a torque signal to an elevator motor;

an elevator motor, responsive to said drive signal for moving an elevator.

12. The elevator system of claim 11, wherein said event is motion of said elevator car.

13. The elevator system of claim 11, wherein said event is the expiration of a time for the duration of said variable stiction removing velocity signal.

14. The elevator system of claim 11, wherein said method is executed only when said elevator is not in a regenerative mode.

15. The method of claim 11, wherein said method is not executed if said elevator, including an elevator load, approximately balances a counterweight to said elevator.

16. The method of claim 11, wherein said variable stiction removing velocity signal is a step function, the magnitude of which is a function of a duty load for said elevator.

17. The method of claim 11, wherein said variable stiction removing velocity signal is a ramp function, the slope of which is dependent upon a duty load for said elevator.

18. The method of claim 11, wherein said elevator is a geared elevator and wherein said variable stiction removing velocity signal is a step function, the magnitude of which is a function of a gear ratio associated with said geared elevator.

19. The method of claim 11, wherein said elevator is a geared elevator and wherein said variable stiction removing velocity signal is a ramp function, the slope of which is a function of a gear ratio associated with said geared elevator.

20. The method of claim 11, wherein said variable stiction removing velocity signal is varied in response to a load signal.

* * * * *